US010682002B2

(12) United States Patent
Miller

(10) Patent No.: US 10,682,002 B2
(45) Date of Patent: Jun. 16, 2020

(54) DOOR HANGING FOLDABLE AND DETACHABLE MAILBOX

(71) Applicant: Jorge Miller, Bronx, NY (US)

(72) Inventor: Jorge Miller, Bronx, NY (US)

( * ) Notice: Subject to any disclaimer, the term of this patent is extended or adjusted under 35 U.S.C. 154(b) by 0 days.

(21) Appl. No.: 16/272,597

(22) Filed: Feb. 11, 2019

(65) Prior Publication Data

US 2019/0246828 A1 Aug. 15, 2019

Related U.S. Application Data

(60) Provisional application No. 62/629,425, filed on Feb. 12, 2018.

(51) Int. Cl.

| | |
|---|---|
| ***A47G 29/12*** | (2006.01) |
| ***A47G 29/124*** | (2006.01) |
| *A47G 29/14* | (2006.01) |

(52) U.S. Cl.

CPC ..... *A47G 29/1216* (2013.01); *A47G 29/124* (2013.01); *A47G 2029/144* (2013.01); *A47G 2400/126* (2013.01)

(58) Field of Classification Search

CPC .. A47G 29/1216; A47G 29/124; A47G 29/14; A47G 29/16; A47G 29/20; A47G 2029/144; A47G 2029/148; A47G 2400/126; B65D 7/20

USPC ..... 232/19, 1 E, 38, 39, 45; 220/485

See application file for complete search history.

(56) References Cited

U.S. PATENT DOCUMENTS

| | | | | | |
|---|---|---|---|---|---|
| 1,742,272 | A | * | 1/1930 | Musoman | A47G 29/20 232/41 R |
| 1,840,561 | A | * | 1/1932 | Bre Miller | B65B 3/006 220/810 |
| 3,706,411 | A | | 12/1972 | Klein | |
| 3,891,139 | A | | 6/1975 | Redling | |
| 4,703,850 | A | * | 11/1987 | Walker | A45C 3/12 206/288 |
| 4,848,650 | A | | 7/1989 | Roberts, II | |
| 4,909,052 | A | * | 3/1990 | Hutwohl | A47G 29/20 109/50 |
| 5,027,948 | A | * | 7/1991 | Forbes | G11B 23/023 206/387.11 |
| 5,056,711 | A | | 10/1991 | Bush | |
| 5,072,828 | A | * | 12/1991 | Irvine | B65D 7/20 220/4.33 |
| 5,178,320 | A | | 1/1993 | Bertone | |
| 5,624,071 | A | * | 4/1997 | Sosan | A47G 29/20 232/1 B |
| 6,155,715 | A | * | 12/2000 | Lake | A47G 29/20 150/102 |
| D644,814 | S | * | 9/2011 | Clarke | D99/33 |

(Continued)

*Primary Examiner* — William L Miller

(74) *Attorney, Agent, or Firm* — Wilmer Cutler Pickering Hale and Dorr LLP

(57) ABSTRACT

This disclosure relates generally to novel system comprised to provide a foldable and removable mailbox or drop box which attaches securely to a door, window or the like by pinning its hook or wedge between the door, window etc. It is made out of soft and flexible outer materials so that it is safe to deploy in hallways and walkways, common areas, etc. Current invention has a very self-intuitive design so that it could be deployed without tools and no tedious installation required. This invention will reduce loss of delivery goods and items due to theft, open exposure when user is not at home.

8 Claims, 6 Drawing Sheets

(56) References Cited

U.S. PATENT DOCUMENTS

| | | | | |
|---|---|---|---|---|
| 9,596,952 | B2 * | 3/2017 | Mencel | A47G 29/20 |
| 10,026,054 | B1 * | 7/2018 | Staton | G06Q 10/0832 |
| 10,076,204 | B1 * | 9/2018 | Sadeghi | A47G 29/141 |
| 10,143,321 | B2 * | 12/2018 | Hippert | A47G 29/20 |
| 10,321,780 | B1 * | 6/2019 | James | A47G 29/16 |
| 2016/0051073 | A1 * | 2/2016 | Heinz | A47G 29/141<br>232/39 |
| 2017/0127868 | A1 * | 5/2017 | Adewuyi | A47G 29/141 |
| 2018/0296016 | A1 * | 10/2018 | Teoh | A47G 29/20 |
| 2019/0133362 | A1 * | 5/2019 | Gilligan | A47G 29/20 |

* cited by examiner

DOOR HANGING FOLDABLE AND DETACHABLE MAILBOX

This application claims the benefit under 35 U.S.C. § 119(e) to U.S. Provisional Patent Application No. 62/629,425, entitled Door Hanging Foldable and Detachable Mailbox, filed on Feb. 12, 2018, the contents of which are incorporated in its entirety by reference herein.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

BACKGROUND

Field of the Invention

The present invention relates to delivery and shipping mailbox or drop box apparatuses for parcels and goods. More particular, the invention relates to delivery and shipping mailbox or drop box that is secure, soft body, removable, fold-able and safe to be deployed in hallways, walkways, common areas, entrances, and other similar locations.

Description of the Related Art

Fixed delivery mailboxes or drop boxes or the like have been used for years. Conventionally the market offers different sizes, designs and colors, yet there are notable challenges that keep a large percentage of the people refrain from acquiring them. Their size and hardness which could be an obstruction of pathways, walkways, common areas, etc., and their tedious installation requirement are all the reasons which made the general drop boxes obsolete and thus there is a dire need for an improved way for holding parcels and goods. In addition, such delivery mailboxes and drop boxes are typically permanently installed, and therefore, cannot be easily removed when no delivery is expected, nor can they be easily reinstalled when a delivery is expected. In addition, even if removable, the size and hard structure make storage of such boxes difficult and impractical.

As can be seen by reference to the following U.S. Pat. Nos. 5,178,320; 5,056,711; 4,848,650; 3,891,139, and, 3,706,411, the prior art is replete with myriad and diverse compartmented mailbox constructions. Usually envelopes and other items have also heretofore been devised for hanging on doorknobs. Such devices, sometimes called doorknob hangers, are particularly well suited for non-mail delivery to customers because some type of knob can be found on the front door of almost every residence and because non-mail items are prohibited from placement in mail boxes. Items placed on a customer's front door are unlikely to be disregarded or overlooked since the doorknob must generally be manipulated in order to obtain ingress or egress. The probability of receipt of such materials is further increased by the fact that they are displayed in plain view and within easy reach of a person using the front door. Hanging materials on doorknobs is regarded as an effective alternative to conventional mail delivery.

The conventional and lack of an appropriate secure mailbox or drop box for delivery of parcels of goods, including mail, packages, groceries, food, medical dugs and equipment, entails a large number of user's loss or damaged goods due to harm caused by the open exposure to elements like weather, pets, vandalism, theft, etc.

However, to Applicant's knowledge, none of these prior art methods have been found to be completely suitable to meet these needs and are cumbersome, impractical, unsecure, and non-durable. Hence, the inventor of the present invention proposes to resolve and surmount existent technical difficulties and to eliminate the aforementioned shortcomings of the prior art. The overall combination of these features is not disclosed in the prior art cited above which appears to be representative of the general art in this area although it is not intended to be an all-inclusive listing of pertinent prior art patents.

Accordingly, an aspect of the present disclosure aims to solve the problems with other mailbox or drop boxes for delivery. See https://www.youtube.com/watch?v=jWnGEwRy-6Y, https://www.youtube.com/watch?v=JcswZoZ816w.

SUMMARY

In light of the disadvantages of the prior art, the following summary is provided to facilitate an understanding of some of the innovative features unique to the present invention and is not intended to be a full description. A full appreciation of the various aspects of the invention can be gained by taking the entire specification, claims, drawings, and abstract as a whole.

According to a first embodiment the present invention's general purpose is to provide unique mailbox or drop box or the like, that is relatively secure and easy to operate, deploy, and store.

Another embodiment of the invention is, compact, removable, fold-able and made of a strong yet soft body material ideal for deploying in hallways, walkways or the like without it being an accident or obstruction hazard.

Another embodiment of the invention is, unique design so it could be deployed without tools and no technical installation is required.

Embodiments of the invention relates to a mailbox or Dropbox that attaches to a door, window, wall or the like. It has a secure locking device to protect delivery goods from unnecessary and unwanted involvement. This invention has strap(s), cord(s), chain(s), etc. that attach to the designated door, window, or the like, and is to accept parcels and goods deliveries.

Many objects of this invention will appear from the following description and appended claims, reference being made to the accompanying drawings forming a part of this specification wherein like reference characters designate corresponding parts in the several views.

This Summary is provided merely for purposes of summarizing some example embodiments, so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
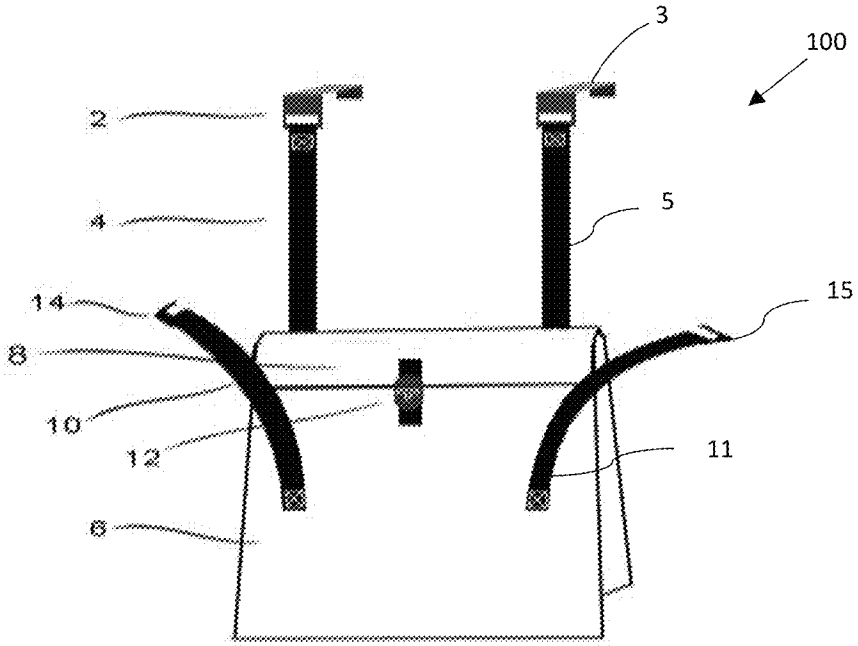
FIG. 1 shows the schematic view of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

Embodiments of the present invention relate to modular, cost effective, design-efficient, removable and fold-able mailbox or drop box which could be attached to a door, window or the like.

The invention is a new and improved system comprised to provide a fold-able and removable mailbox so it does not need lot of space to be deployed. It is made out of soft and flexible outer materials so that it is safe to deploy in hallways and walkways, common areas, etc. Current invention has a very self-intuitive design so that it could be deployed without tools and no tedious installation required.

FIG. 1 shows the exterior view of a drop device 100. Drop device 100 includes securing mechanisms 2 and 3, holding straps 4 and 5, holding compartment 6, closing mechanism 8, stabilizing straps 10 and 11, lock mechanism 12, and stabilizing strap securing mechanisms 14 and 15.

To hold the drop device 100 there are securing mechanisms 2 and 3. Securing mechanisms 2 and 3 can be, for example, be hooks made of metal, plastic or other material which secures the drop device 100 against a door, window or comparable, by wedging between the door or the like and its frame. The hooks can be coated, for example with a layer of enameled paint, to avoid damaging that to the door, window, or comparable, and its frame. While FIG. 1 shows two securing mechanisms 2 and 3, the drop device 100 can have more securing mechanisms to provide more stability, or fewer for simplified use.

Securing mechanisms 2 and 3 are securely attached to holding straps 4 and 5 to hold drop device 100. Holding straps 4 and 5 can be designed to be flexible and light weight such that the drop device 100 can be easily installed and removed, and easily stored. For example, holding straps 4 and 5 can be made of fabric, metal, plastic, rubber, or other material. Holding straps 4 and 5 can also have a strengthening or cut resistant member(s) disposed therein. For example, holding straps can be wires or chains, for example made of metal, that allow them to support heavier loads in the drop device 100 and/or that are further resistant to cutting so as to prevent removal of the bag from the structure to which it is attached.

Figure 2:
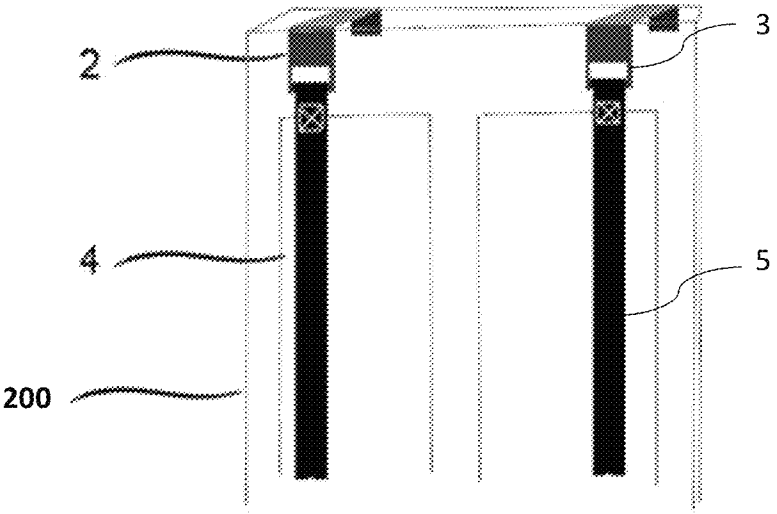
FIG. 2 shows the deployment of the invention.
Figure 3:
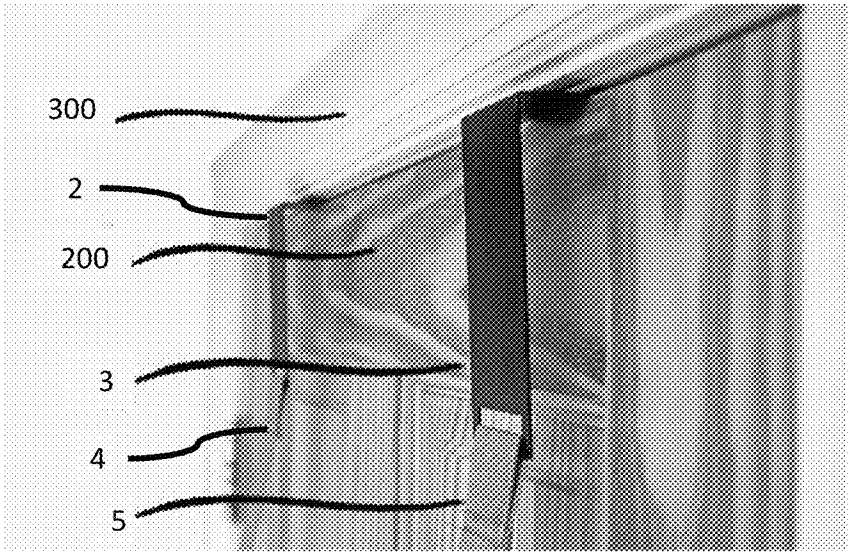
FIG. 3 shows the deployment of the invention with a closed door.

In addition, holding straps 4 and 5 hold the drop device 100 in place at a correct distance from the door or the like. Holding straps 4 and 5 can be made adjustable to hold the drop device 100 in the correct location with respect to the door or the like. For example, the holding straps 4 and 5 can be the correct length, or adjustable such that the drop device 100 does not block essential features of the structure to which it is secured. For example, if drop device 100 is secured to a door, as shown in FIGS. 2-3, the straps should be provided at the correct length, or adjusted by the user, such that the drop device 100 does not block peep holes/viewers, mail slots, door numbers, door knobs, locks, or other important features of the door.

The holding compartment 6 is attached to the holding straps 4 and 5, and secured via securing mechanisms 2 and 3 to the door, window, or the like. The holding compartment 6 can be, for example, a container or bag made of fabric, metal, plastic, rubber, or other material. On at least one face of the holding compartment 6 is an opening into which objects can be placed. The holding compartment 6 can be made of desirable size to hold boxes, packages, groceries, food, medical drugs or devices, or other type of deliveries. Holding compartment 6 can have a bottom surface that is rigid such to support the contents of the holding compartment 6, and can have other rigid portions to give the holding compartment 6 a desired structure.

Cover flap 8 is attached to holding compartment 6 and is used to securely cover the opening of the holding compartment 6. Cover flap 8 can be made of the same or of different material to the holding compartment 6. For example, cover flap 8 can be made of fabric, metal, plastic, rubber, or other material. Cover flap 8 can be integrally formed with the material of holding compartment 6.

Holding compartment 6 and cover flap 8 can be designed to be flexible and light weight such that the drop device 100 can be easily installed and removed, and easily stored. As discussed above, for example, holding compartment 6 and cover flap 8 can be made out of fabric, metal, plastic, rubber, or other material. The material can be cut or puncture resistant so as to avoid theft or damage to the items stored in holding compartment 6. In addition, holding compartment 6 and cover flap 8 can be designed to be waterproof such to protect the contents of the holding compartment 6 from the elements. Holding compartment 6 and cover flap 8 can also be designed to be insulating so as to preserve the temperature of contents therein, for example, groceries, food, medical drugs, or medical devices.

Stabilizing straps 10 and 11, similar to the holding straps 4 and 5, can be provided to further attach the holding compartment 6 to the door, window, or the like. Stabilizing straps 10 and 11 are attached to stabilizing strap securing mechanisms 14 and 15, similar to securing mechanisms 2 and 3, for example a hook or other attaching method, in order to attach the stabilizing straps 10 and 11 to a door, window, or the like. When attached to a door, window, or the like through stabilizing strap securing mechanisms 14 and 15, stabilizing straps 10 and 11 stabilize the weight of the drop device 100 in a desirable position. Stabilizing strap securing mechanisms 14 and 15, for example made of fabric, metal, plastic, rubber, or other material attach, sticks to, grab or hook to the stabilizing straps 10 and 11, and allow it to attach, stick, hook on to the holding straps 4 and 5 so that to stabilize the holding device 100 position.

For example, stabilizing straps 10 and 11 can help keep the drop device 100 level, or in a particular orientation. Stabilizing straps 10 and 11 can also be designed to be flexible and light weight such that the drop device 100 can be easily installed and removed, and easily stored. For example, stabilizing straps 10 and 11 can made of fabric, metal, plastic, rubber, or other material. Stabilizing straps 10 and 11 can be made a desired length, or made adjustable, to help secure drop device 100 in the desired position. For example, the stabilizing straps 10 and 11 can be the correct length, or adjustable such that the drop device 100 does not block essential features of the structure to which it is secured, similar to holding straps 4 and 5. Stabilizing straps 10 and 11 can also have a strengthening or cut resistant member disposed therein, similar to holding straps 4 and 5. For example, holding straps can wires or chains, for example made of metal, that allow them to support heavier loads in the drop device 100 and/or that are further resistant to cutting so as to prevent removal of the bag from the structure to which it is attached.

Secure locking mechanism 12 secures the cover flap 8 to the holding compartment 6. Secure locking mechanism 12 can be made of fabric, metal, plastic, rubber, or other material and is a multi-part mechanism. It locks and hides the opening of holding compartment 6. Locking mechanism 12 can, for example, be a combination lock, key lock, key pad lock, or other locking device. In one embodiment, a user of the drop device 100 can supply the lock combination or a key to the seller of a good or a delivery service so that the delivery service can access the opening of holding compartment 6 to store the delivered goods.

In one embodiment, the drop device 100 can have an electronic lock for the locking mechanism 12 that can interface with a network such as a wireless network or the like. The drop device 100 can sense, for example by a weight sensor, that a package has been delivered, and then lock the locking mechanism 12 once the holding compartment 6 and/or locking mechanism 12 are closed. The sensor can also be used to notify the user that a package has been delivered. In addition, the locking mechanism 12 can be controllable from a remote location, for example by personal computing device or wireless device, to lock and unlock to selectively allow access to the inside of holding compartment 6. The lock mechanism 12 can also include a scanning system that scans the label of an item to be delivered to unlock and provide access to the holding compartment 6, and can lock when closed with delivery inside.

The drop device 100 can also have an alarm device to alert when the drop device 100 has been tampered with. The alarm device can detect, for example, cutting, puncturing, excessive pulling, or unauthorized opening of the drop device 100. The alarm device can alert using sound and/or lights to notify those around the drop device 100 that it is being tampered with. The alarm device can also alert by notifying the user of the drop device that it is being tampered with, for example, through a wireless network or the like.

The drop device 100 can also include a handle disposed on the holding compartment 6 or the cover flap 8. The handle can make the drop device 100 easier to carry and transport, especially when something is stored within the holding compartment 6.

FIG. 2 shows how the drop device 100 can be installed by putting the securing mechanisms 2 and 3 over door 200. The securing mechanisms 2 and 3 secure the drop device 100 against a door 200, window or comparable, by wedging between the door or the like and its frame 300. For example, securing mechanisms 2 and 3 can be placed over door 200, and door 200 can be closed causing the securing mechanisms 2 and 3 to be wedged between door 200 and its frame 300. Securing mechanisms 2 and 3 can, for example, have two bends, as shown in FIG. 2, such that at least part of the securing mechanisms 2 and 3 are disposed behind the door 200 and hook around the door 200 to prevent the securing mechanisms 2 and 3 from being pulled out of the wedged position between door 200 and its frame 300. As also shown in FIG. 2, holding straps 4 and 5 hold the drop device 100 in place at a correct distance from the door 200 or the like.

FIG. 3 shows another installation illustration with a closed door 200 within a frame 300. The door 200 and frame 300 are shown that will hold or support the invention. There are securing mechanisms 2 and 3 which secure the invention against a door, window or comparable, by wedging between the door 200 or the like and its frame 300. The holding straps 4 and 5 made of fabric, metal, plastic, rubber, or other material hold the drop device 100.

In an embodiment, the securing mechanisms 2 and 3 can be placed on the top of the door 200 or the like so as to be supported by gravity. In another embodiment, securing mechanisms 2 and 3 can be placed on the side, sides, or bottom of the door 200 or the like so as to be easier to secure the drop device 100 on large doors, or for shorter users to secure the drop device 200 to a door. In another embodiment, the securing mechanisms 2 and 3 can be wedged between any surface of door 200 or the like and its frame 300, for example, top and bottom, side and top, and side and bottom. In another embodiment, securing mechanisms 2 and 3 can be disposed entirely on the opposite side of the door 200 or the like from the drop device 100 such that holding straps 4 and 5 are wedged between the door 200 or the like and the frame 300. In such configuration, securing mechanisms 2 and 3 can, for example, attach to a doorknob or other fixture on the opposite side of the door from the drop device 100, and can comprise hooks, rings, or loops to form said attachment.

Figure 4A:
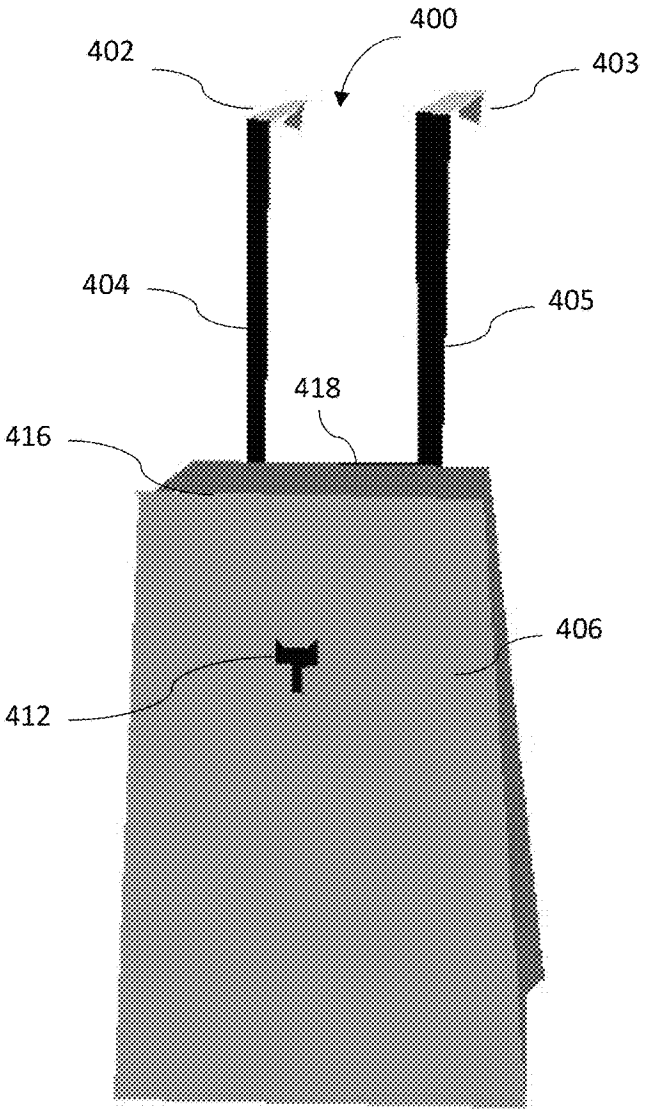
FIGS. 4A-4B show a schematic view of another embodiment of the invention.
Figure 4B:
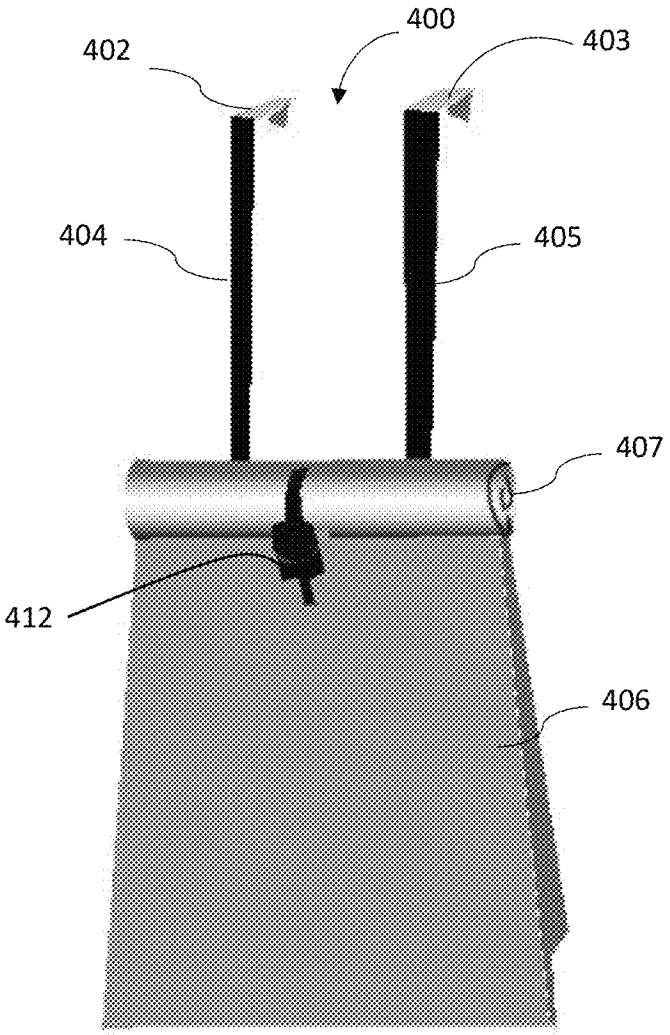

FIGS. 4A-B depict an additional embodiment of the present invention. FIG. 4A depicts the drop device 400 in an open and unlocked position. The top of holding compartment 406 can be rolled so as to close the opening and secure the contents of holding compartment 406. FIG. 4B shows the drop device 400 with holding compartment 406 closed and sealed via rolled portion 407, and locked via locking mechanism 412. The rolled portion 407 helps seal the drop device and protect the contents of holding compartment 406 from loss or damage due to harm caused by open exposure to elements like weather, pets, vandalism, theft, etc. In an additional embodiment, the drop device 400 can be provided with cover flap, similar to cover flap 8, that is rolled with the top of holding compartment 406 when closing the opening of holding compartment 406.

The front portion of holding compartment 406 can have a front elongated support member extending across the top edge 416 of the front portion of the holding compartment 406. The front elongated support member can, for example, be a front elongated support rod made of wood, metal, or other rigid material. The back portion of holding compartment 406 can have a back elongated support member extending across the top edge 418 of the back portion of the holding compartment 406. The back elongated support member can, for example, be a back elongated support rod made of wood, metal, or other rigid material. The front elongated support member and the back elongated support member can be placed together, in parallel, and rolled together to create rolled portion 407, thereby closing and sealing the opening of holding compartment 406. The front elongated support member and the back elongated support member provide an easier way of rolling the holding compartment 406 and provide additional security for the contents inside the holding compartment 406.

Drop device 400 is also provided with holding straps 404 and 405 that connect with securing mechanisms 402 and 403. Holding straps 404 and 405 can be similar or identical to holding straps 4 and 5, discussed above. Securing mechanisms 402 and 403 can be similar or identical to securing mechanisms 2 and 3, discussed above. Lock mechanism 412 can be similar or identical to lock mechanism 12, as discussed above. Holding compartment 406 can be similar or identical to holding compartment 6, discussed above. Drop device 400 may also be provided with stabilizing straps and corresponding attachment mechanisms, similar or identical to stabilizing straps 10 and 11 and stabilizing strap securing mechanisms 14 and 15, as discussed above.

Figure 5:
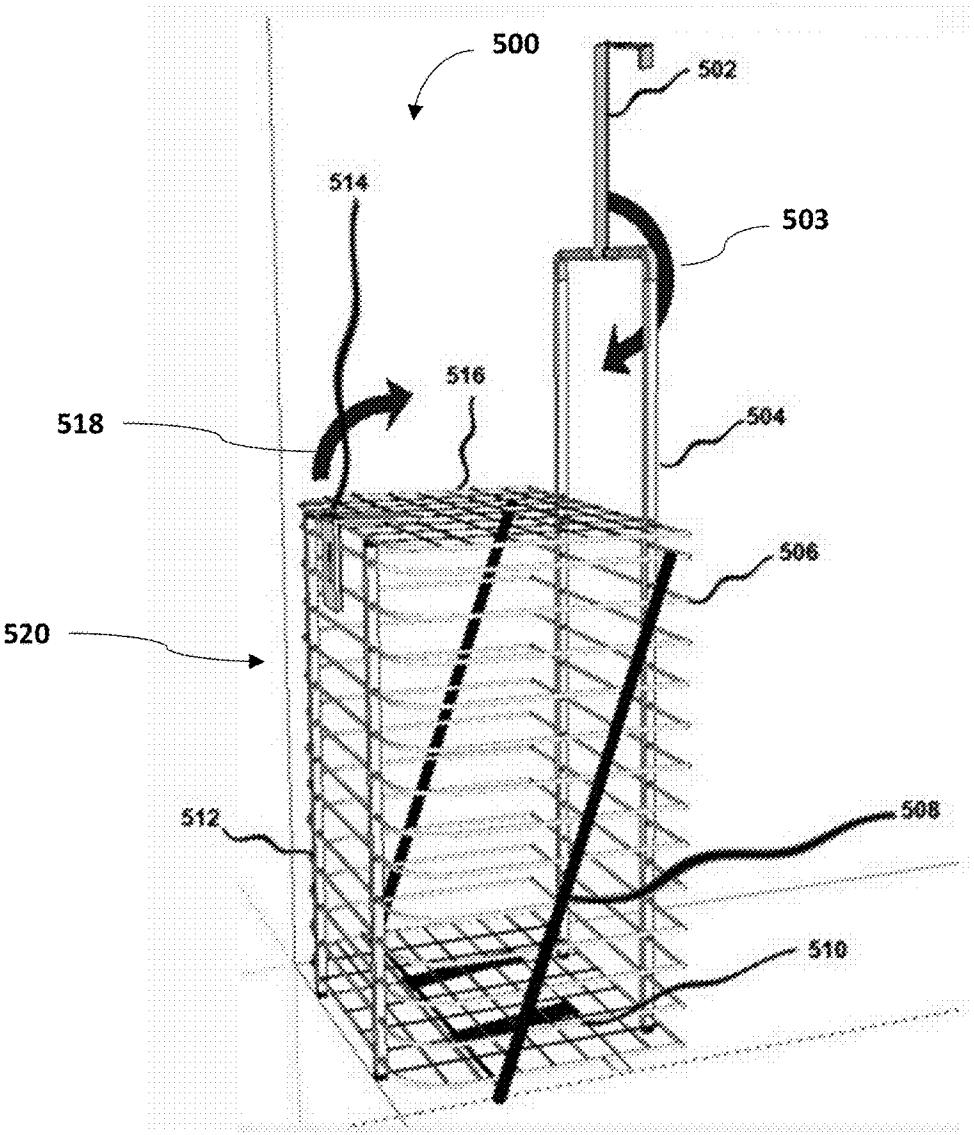
FIG. 5 shows a schematic view of another embodiment of the invention.

FIG. 5 depicts an additional embodiment of the present invention. FIG. 5 depicts the drop device 500, which includes securing mechanism 502, back support 504, frame bars 506, support bars 508, cage 520, front support bars 512, lock mechanism 514, device cover 516, and base 510.

Securing mechanism 502 is included to hold the drop device 500. For example, securing mechanism 502 can be similar to the securing mechanisms 2, and 3, discussed above. FIG. 5 depicts one securing mechanism 502, although any number of securing mechanisms can be included, for example, to provide greater stability.

Securing mechanism 502 is connected to back support 504. This connection is optionally made pivotal such that the securing mechanism 502 can fold in direction of arrow 503 for more compact storage. Back support 504 provides support for and serves as part of the rear side of cage 520. Although FIG. 5 depicts back support as a squared upside-down "U" shape, any shape is contemplated. In certain embodiments, the back support 504 can be adjustable to allow the drop device to be attached to a variety of different objects, and to provide easy access.

In certain embodiments, the cage 520 can be made of back support 504, frame bars 506, support bars 508, and front support bars 512. For example, as depicted in FIG. 5, back support bars 504 and front support bars 512 are placed at opposite sides of the cage to provide support for frame bars 506. In certain embodiments, the back support bars 504 and front support bars 512 extend in a vertical direction from the base 510 to device cover 516, and frame bars 506 extend horizontally between back support bars 504 and front support bars 512 to provide structure or the cage 520. In certain embodiments, the device cover 516, base 510, back support 504, frame bars 506, and support bars 512 give cage 520 a cubic, rectangular cuboid, or other three dimensional shape capable of storing, for example, packages. The edges of cage 520 may be optionally rounded, as shown in FIG. 5, or optionally cornered, as also shown in FIG. 5. Cage 520 may also be optionally provided with frame bars 508 on the side of cage 520 to provide further structure and support. Frame bars 508 may be placed diagonally across frame bars 506, vertically across frame bars 506, or the like to provide support for cage 520. The base 510 and device cover 516 can be made, for example, of crossed bars, as shown in FIG. 5. Any number of bars can make up back support 504, frame bars 506, support bars 508, front support bars 512, base 510, and device cover 516 to make cage 520. Back support 504, frame bars 506, support bars 508, front support bars 512, base 510, and device cover 516 can be made of, for example, wood, plastic, metal, or the like. In some embodiments, back support 504, frame bars 506, support bars 508, front support bars 512, base 510, and device cover 516 are made from a material of sufficient hardness and thickness to prevent easy access to the inside of cage 520. In certain embodiments, back support 504, frame bars 506, support bars 508, front support bars 512, base 510, and device cover 516, and bars making up device cover 516 and base 510 can be spaced appropriately for maintaining items of various sizes therein. In certain embodiments, multiple sizes or thicknesses of material can be provide as back support 504, frame bars 506, support bars 508, front support bars 512, base 510, and device cover 516, and bars making up device cover 516 and base 510. The different thicknesses of material can provide one or more of structural rigidity, security from theft, or security from vandalism or damages. In certain embodiments, thicker material can provide structural rigidity, while thinner material provides added protection from theft or vandalism.

Device cover 516 is pivotally or hingedly attached to cage 520, such as to back support 504 such to provide access to the inside of cage 520. For example, device cover 516 can be attached to back support 504 at one side so that it can open in the direction of arrow 518. In certain embodiments, device cover 516 is also connected to cage 520 via lock mechanism 514, which can be similar or identical to and can provide similar or identical functionality as lock mechanism 12, discussed above.

The cage 520 of drop device 500 provides protection for the contents held therein. For example, if the cage 520 can provide added protection against theft or vandalism of the contents held therein. In certain embodiments, the cage 520 improves the rigidity of drop device 500 so that it does not deform when carrying heavy or large contents therein, and to improve durability. In certain embodiments, the drop device 500 can be implemented as a standalone device for receiving boxes, packages, groceries, food, medical drugs or devices, or other type of deliveries. In certain embodiment, the drop device 500 can be implemented as a frame disposed on the inside or the outside of the previous embodiments discussed above to provide added security and/or structure.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separately claimed subject matter.

The invention claimed is:

1. A storage receptacle for storing deliverable goods and releasably attaching to a moveable fixture, the storage receptacle comprising:

a holding compartment having a bottom surface, side surfaces, and an opening at a top of the holding compartment defined by the side surfaces, the opening configured to receive and store deliverable goods when the holding compartment is in an open position, the holding compartment comprising a flexible, foldable fabric and including a portion of the side surfaces of the compartment that is rollable along the side surfaces to close the opening by rolling the holding compartment into a rolled configuration;

a locking mechanism comprising a first portion attached to one of a front surface or a back surface of the holding compartment and a second portion attached to the other of the front surface and the back surface of the holding compartment, the first and second portions each including a respective portion of an engaging lock, the respective lock portion of the first portion configured to engage the respective lock portion of the second portion around at least part of a rolled portion of the holding compartment when the holding compartment is in the rolled configuration such to secure the holding compartment in the rolled configuration, the lock configured to lock the first portion and the second portion in engagement; and a plurality of holding mechanisms, one end of each of the plurality of holding mechanisms being attached to the holding compartment, an other end of each of the plurality of holding mechanisms having a respective securing mechanism attached thereto, each of the plurality of holding mechanisms comprising a flexible, foldable fabric, wherein each of the plurality of securing mechanisms are configured to removably secure to an edge of a door or a window, such that the storage receptacle is removably secured to the door or the window;

and wherein the holding compartment is flexible and foldable to be capable of folding for storage.

2. A method of releasably attaching the storage receptacle of claim 1 to the door or the window, the method comprising:

removably securing the plurality of securing mechanisms to one of the open door or the open window;

closing the open door or the open window such that each of the plurality of securing mechanisms is wedged between the closed door or the closed window and a frame of the closed door or the closed window.

3. A method of releasably attaching the storage receptacle of claim 1, the method comprising:

removably securing the plurality of securing mechanisms to one of the open door or the open window;

closing the open door or the open window such that each of the plurality of securing mechanisms is disposed on one side of the closed door or the closed window, the holding compartment is disposed on the other side of the closed door or closed window, and the holding mechanisms are wedged between the closed door or the closed window and a frame of the closed door or the closed window.

4. The storage receptacle of claim 1, wherein the holding compartment includes a cage having crossed bars disposed within the holding compartment to provide structure to the holding compartment, the cage having rounded corners.

5. The storage receptacle of claim 4, wherein the crossed bars form a base, at least three sides, and a closing mechanism.

6. The storage receptacle of claim 1, wherein the plurality of holding mechanisms are further configured to be adjustable in length.

7. The storage receptacle of claim 1, wherein the flexible, foldable material of the holding compartment is waterproof.

8. The storage receptacle of claim 1, wherein each securing mechanism comprises a hook or a wedge.

* * * * *